United States Patent [19]

Evans et al.

[11] Patent Number: 4,960,966

[45] Date of Patent: Oct. 2, 1990

[54] LIMIT SWITCH

[75] Inventors: William B. Evans; Charles F. Evans, III, both of Louisville, Ky.

[73] Assignee: Enterprise Sales & Company Inc., Louisville, Ky.

[21] Appl. No.: 431,928

[22] Filed: Nov. 6, 1989

[51] Int. Cl.[5] ..... H01H 3/16

[52] U.S. Cl. ..... 200/61.41; 200/61.42

[58] Field of Search ..... 200/47, 61.41, 61.42, 200/293

[56] References Cited

U.S. PATENT DOCUMENTS

| | | | |
|---|---|---|---|
| 3,202,779 | 8/1965 | Call | 200/61.42 |
| 3,519,770 | 7/1970 | Long et al. | 200/61.42 |
| 3,718,785 | 2/1973 | Kudritzki | 200/61.41 |

*Primary Examiner*—J. R. Scott

*Attorney, Agent, or Firm*—Edward M. Steutermann

[57] ABSTRACT

Switch device including an enclosure having a pivot or shaft arm extending across the enclosure with a distal arm attached thereto for selective contact to move the shaft to indicate the presence of an object. The pivotal shaft carries a actuator device for rotational movement with movement of the distal arm, a stop device connected from the inside surface of the enclosure extending toward the actuator device to engage the actuator device and limit the movement of the actuator device in a first direction, a sensor device normally located in proximity to the actuator device when the actuator device engages the stop device, a generally oval elastomeric spring device attached to the inner surface of the enclosure and adapted to normally to engage the side of the actuator device opposite the sensor device to bias the actuator device to engagement with the stop device and to allow the movement of the actuator device away from the stop device and the sensor device upon engagement of an object with the distal arm.

1 Claim, 1 Drawing Sheet

LIMIT SWITCH

BACKGROUND OF THE INVENTION

The present invention relates, in general, to switch devices and more particularly relates to switch devices useful in hostile environments.

Devices within the scope of the present invention belong, in general, to a broad classification of spring return indicator type switch devices which are moved from a first position to a second position by an occurrence such as the presence of a moving object. Devices within the general scope of the present invention, that is bias or switch devices are useful in numerous of applications from a simple spring loaded cam operated switch to complicated switches which are useful in certain hostile environments.

Devices of the type contemplated by the present invention are useful in extremely hostile environments such as to detect the movement of a roller conveyor belt to shut down a conveyor line to prevent escape of the belt from the retaining rollers for example in mining, mineral processing, or transporting coal.

In such applications it is particularly important that the switch device be of rugged construction and capable of induring the most agueous service. Additionally, the switch devices in such applications encounter hostile environments such a sulfur compound which easily penetrate many mechanical devices. Accordingly, it is important that devices for such service be completely sealed from the atmosphere and have a minimum of number of moving parts located outside of any enclosure in which the operating parts are housed to minimize the likelihood of the effects of the corrosive atmosphere.

Examples of devices provided by the prior art for such application include Ramsey Pro-Line TM safety cable pull switches, as well as other similar devices which operate a switch means. In general such devices do not provide means for protection of the switch device from over travel or rapid movement of the actuating lever which is usually associated with such devices. Similar, devices are also manufactured by "Square D" and others.

No prior art arrangement is known which provides the multiple advantages of switch means within the scope of the present invention.

SUMMARY OF THE INVENTION

The present invention provides a new, useful, and highly reliable switch device for use in rough industrial applications, and which can be used in hostile environments.

Devices within the scope of the present invention allow the use of noncontact switch means in order to limit the movement of the actuator device to prevent engagement of the device with the switch means, which is typically a non contact sensor as opposed to a microswitch or contact type switch in the prior art.

Moreover, because of the construction provided by devices within the scope of the present invention the units can be easily sealed to prevent the intrusion of corrosive components from the surrounding environments and thus devices within the scope of the present invention can be used in the most rigorous applications. Also, devices within the scope of the present invention can be adapted as to size and actuating points by simple adjustment of threaded adjusting stops and switches within the unit so that once the device is installed adjustments can be made to accommodate the current characteristics of the application as well as characteristics resulting from changes in operating mode.

More particularly, the present invention provides a switch device including an enclosure having a pivot arm extending across the enclosure with a distal arm attached thereto for selective contact to move the shaft indicate the presence of an object where the pivotal shaft carries a actuator device for rotational movement with movement of the distal arm, a stop connected from the inside surface of the enclosure extending toward the actuator device to engage the actuator device and limit the movement of the actuator device in a first direction, a sensor normally located in proximity to the actuator when the actuator device engages the stop device, a generally oval elastomeric spring device attached to the inner surface of the enclosure and adapted to normally to engage the side of the actuator device opposite the sensor device to bias the actuator device to engagement with the stop device and to allow the movement of the actuator device away from the stop device and the sensor upon engagement of an object with the distal arm.

Examples of one arrangements within the scope of the present invention are provided in the accompanying drawings and discussed hereinafter but it will be understood that other arrangements, also within the scope of the present invention will occur to those skilled in the art upon reading the disclosure set forth hereinafter.

BRIEF DESCRIPTION OF THE DRAWINGS

In the examples in accordance with the present invention illustrated in the drawings and discussed hereinafter.

DETAILED DESCRIPTION OF THE DRAWINGS

Figures 1, 2A, 2B:
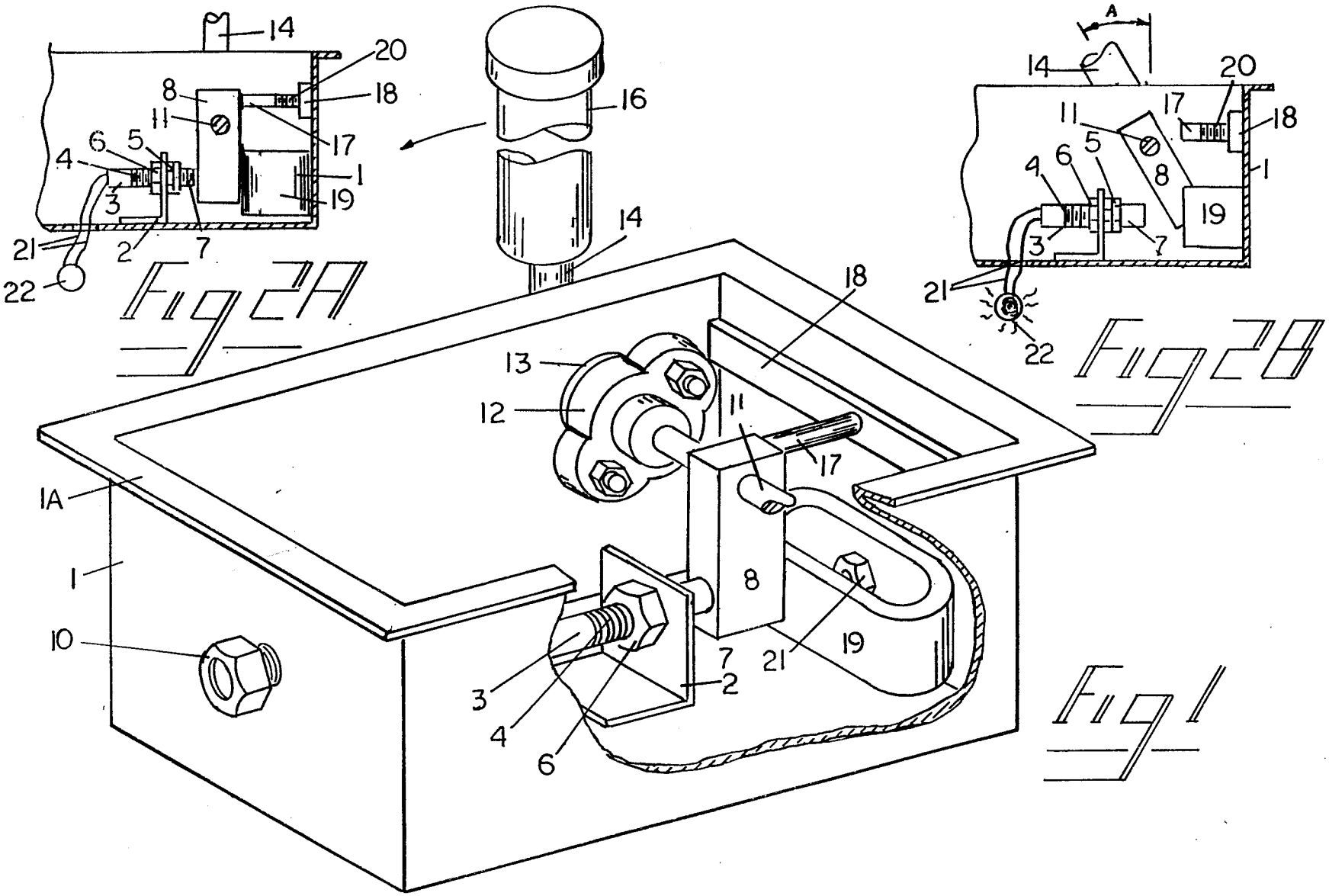
FIG. 1 is a perspective view, partially in section, of one example of an arrangement within the scope of the present invention.
FIGS. 2A and 2B illustrate one mode of operation of a device of the type shown in FIG. 1.

FIG. 1 is a perspective illustration of an arrangement within the scope of the present invention. An enclosure 1 is shown having flange 1A which is adapted to receive a lid (not shown) to close the enclosure. The lid is attached to the flange 1A by bolts or other convenient means as known in the art.

The enclosure can be of a corrosion resistant material, for example stainless steel or plastic, or any other suitable material.

Within the enclosure, a bias switch arrangement is provided as shown. An "L" bracket 2 is provided on the base of the enclosure and has the opposite leg extending upwardly and adapted to receive a switch assembly 3. Switch assembly 3 can be of any appropriate character but in general, a proximity type switch such as a GO ® switch manufactured by General Equipment and manufacturing Co., of Louisville, Ky. is particularly satisfactory.

Switch assembly 3 has a threaded section 4 which is adapted to receive a nut 6 to provide one positioning side of the switch assembly. As shown in FIGS. 2A and 2B a second nut 5 can be provided on the opposite side of the bracket 2 to retain the switch in position with sensor end 7 extending outwardly an appropriate distance as described hereinafter.

The switch element 8 is provided as shown. In the case of the GO® switch where the sensor adapted to sense the presence of a ferrous material actuator 8 can be of steel or other appropriate material. The actuator 8 is adapted to be received on a shaft or pivot arm 11 which extends transversely across the enclosure 1, as shown, and is received in a journal 12 as shown (a similar journal being provided) on the opposite side of the enclosure but not shown because of the cut away section of the enclosure. A gasket 13 is provided between journal 12 and the wall to exclude the migration of materials from the outside.

Shaft 11 is then connected to an upstanding shaft 14 which carries a striker or distal arm 16, as is known in the art, so that upon the occurrence of a particular event, such as engagement by side of conveyor belt the striker 16 is engaged and rotates the shaft 11 as described hereinafter.

In accordance with another feature of the present invention a stop 17 is provided in a base 18 and can be longitudinally adjustable within the base 18 to position the end of the stop 17 to engage the upper section of the actuator 8 to restrict movement of the bottom portion of the actuator 8 toward the sensor 7. Typically, the stop 17 is positioned so that at the end of the stop engages the upper portion of the actuator 8 to prevent actual contact between the sensor 7 and the actuator 8. This prevents damage to the sensor which is the operative and most sensitive part of the apparatus.

Referring now to FIG. 2A, the arrangement illustrated in FIG. 1 is shown in cross sectional view with the actuator 8 and the arm 14 located in the normal rest position. In this case the actuator 8 is within the sensing area of the sensor 7 so that the indicator 22 which is connected to the leads 21 from the switch 3 is off. When the striker 16 is engaged by the circumstances which are to be monitored, the shaft 11 and the arm 14 rotate through an angle A as illustrated in FIG. 2B. The resilient bias pad 19 is thus compressed and the actuator 8 is withdrawn from the sensing area 7 of the sensor switch 3 so that the indicator 22 is actuated indicating that the circumstances for which the switch is intended to monitor has in fact occured.

Upon release of the striker 16, the bias pad 19 returns the arrangement to the configuration shown in FIG. 2A.

Thus, the switch arrangement illustrated provides a useful, and highly reliable indication means which can be used in the most rigorous applications.

It will be understood that the foregoing is one example of an arrangement within the scope of the present invention and that various other arrangements also within the scope of the present invention will occur to those skilled in the art upon reading the disclosure set forth hereinbefore.

The invention claimed is:

1. A switch device including an enclosure having a pivot arm extending across the enclosure with an external distal arm attached thereto to indicate the presence of an object, the pivot arm carries, an actuator device for rotational movement corresponding to the movement of the distal arm, a stop device connected to an inside surface of the enclosure extending toward the actuator device to engage the actuator device and limit the movement of the actuator device in a first direction, a sensor located in proximity to the actuator device when the actuator device engages the stop device, a generally circular elastomeric spring device attached to another inside surface of the enclosure and adapted to spring outwardly to normally engage the side of the actuator device opposite the sensor device to bias the actuator device to engagement with the stop device and to allow the movement of the actuator device away from the stop device and the sensor upon engagement of an object with the distal arm.

* * * * *